US008641454B2

(12) United States Patent
Chen et al.

(10) Patent No.: US 8,641,454 B2
(45) Date of Patent: Feb. 4, 2014

(54) ELECTRICAL CONNECTOR

(75) Inventors: Hsin-Hsun Chen, New Taipei (TW); Hui-Wen Liu, New Taipei (TW)

(73) Assignee: Proconn Technology Co., Ltd., Taipei (TW)

( * ) Notice: Subject to any disclaimer, the term of this patent is extended or adjusted under 35 U.S.C. 154(b) by 99 days.

(21) Appl. No.: 13/462,584

(22) Filed: May 2, 2012

(65) Prior Publication Data

US 2013/0295785 A1 Nov. 7, 2013

(51) Int. Cl.
*H01R 12/00* (2006.01)

(52) U.S. Cl.
USPC ..... 439/660; 439/79

(58) Field of Classification Search
USPC ..... 439/660, 79
See application file for complete search history.

(56) References Cited

U.S. PATENT DOCUMENTS 7,686,656 B2 * 3/2010 Zheng et al. ..... 439/660
7,806,735 B1 * 10/2010 Chen et al. ..... 439/676
7,862,346 B1 * 1/2011 Wan et al. ..... 439/79
7,972,182 B2 * 7/2011 Zheng et al. ..... 439/660
8,147,276 B2 * 4/2012 Wang et al. ..... 439/660
8,147,277 B1 * 4/2012 Wang et al. ..... 439/660
8,439,691 B1 * 5/2013 Lan et al. ..... 439/79
2012/0052709 A1 * 3/2012 Ko ..... 439/345
2013/0149910 A1 * 6/2013 Ko ..... 439/660

* cited by examiner

*Primary Examiner* — Gary F. Paumen
(74) *Attorney, Agent, or Firm* — WPAT, P.C.; Anthony King

(57) ABSTRACT

An electrical connector adapted for electrically connecting with a circuit board includes an insulating housing, a plurality of first and second terminals, and a shielding shell enclosing the insulating housing together with the first and second terminals. The insulating housing includes a main body, and a base body assembled to the main body. The base body defines a plurality of first and second terminal grooves. The first and second terminals are respectively assembled to the first and second terminal grooves. Each first terminal has an inclined first connecting arm connected between a first fastening arm and a first soldering arm of the first terminal, and each second terminal has an inclined second connecting arm connected between the second fastening arm and the second soldering arm of the second terminal to effectively shorten straight lengths of the first terminal and the second terminal which are stretched straight.

9 Claims, 5 Drawing Sheets

ELECTRICAL CONNECTOR

BACKGROUND OF THE INVENTION

1. Field of the Invention

The present invention generally relates to an electrical connector, and more particularly to an electrical connector having a plurality of terminals.

2. The Related Art

A conventional electrical connector includes an insulating housing, a plurality of terminals and a shielding shell. The insulating housing has a base portion, and a tongue portion protruding forward from a front of the base portion. The insulating housing defines a plurality of terminal grooves extending longitudinally to pass through a top surface of the tongue portion and the base portion. Each of the terminals has a fastening portion placed horizontally. A front end of the fastening portion extends forward and is further arched upward to form a contact portion. A rear end of the fastening portion extends upward, and then bends rearward to form an inverted-L shaped connecting portion. A free end of the connecting portion extends downward to form a soldering portion. When the electrical connector is assembled, the terminals are assembled forward to the terminal grooves of the insulating housing with the soldering portions projecting behind the insulating housing. Then the shielding shell encloses the insulating housing together with the terminals.

However, the fastening portion and the soldering portion of the terminal are connected by the inverted-L shaped connecting portion that increases a straight length of the terminal which is stretched straight, and causes a high characteristic impedance value of the terminal. Therefore, the electrical connector often fails to pass a high-frequency test. Furthermore, the distances between every two fastening portions of the terminals are so narrow on account of a limited volume of the electrical connector that the terminals are apt to generate signal interferences.

SUMMARY OF THE INVENTION

An object of the present invention is to provide an electrical connector adapted for electrically connecting with a circuit board includes an insulating housing, a plurality of first terminals and second terminals, and a shielding shell. The insulating housing includes a main body, and a base body assembled to the main body. The base body has a base portion, and a second tongue portion protruding forward from a front of the base portion. The base body defines a plurality of first terminal grooves passing through a top of the second tongue portion and a top of the base portion, and a plurality of second terminal grooves passing through a bottom of the second tongue portion and a rear of the base portion. Each first terminal has a first fastening arm which is disposed in the first terminal groove in the base portion. A contact arm extends forward from a bottom end of the first fastening arm and is received in the first terminal groove in the second tongue portion with a front end thereof being arched upward to project beyond the top of the second tongue portion. A top end of the first fastening arm is inclined rearward to form a first connecting arm passing through the top of the base portion. A free end of the first connecting arm extends rearward and then downward to form a first soldering arm of inverted-L shape projecting behind the base body to be inserted in the circuit board. Each second terminal has a fastening strip which is fastened in the second terminal groove in the bottom of the second tongue portion. A contact portion extends forward in a step manner from a front end of the fastening strip to project in front of the base body. A rear end of the fastening strip extends upward to form a second fastening arm of which a free end is inclined rearward to form a second connecting arm. The second fastening arm is disposed in the second terminal groove in the rear of the base portion. A free end of the second connecting arm is bent downward to form a second soldering arm projecting behind the base body to be inserted in the circuit board. The shielding shell encloses the insulating housing together with the first terminals and the second terminals.

As described above, the first fastening arm and the first soldering arm of the first terminal are connected with each other by the inclined first connecting arm, and the second fastening arm and second soldering arm of the second terminal are connected with each other by the inclined second connecting arm to effectively shorten straight lengths of the first terminal and the second terminal which are stretched straight so as to lower the characteristic impedance values of the first terminal and the second terminal. Therefore, the electrical connector may pass a high-frequency test successfully. Furthermore, the first terminals and the second terminals are reversely disposed to the base body of the insulating housing to expand distances between the first terminals and the second terminals, and the fastening strips of the second terminals which are assembled to two sides of the base body have gaps for improving distances between every two adjacent fastening strips so as to effectively prevent the first terminals and the second terminals from generating signal interferences.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
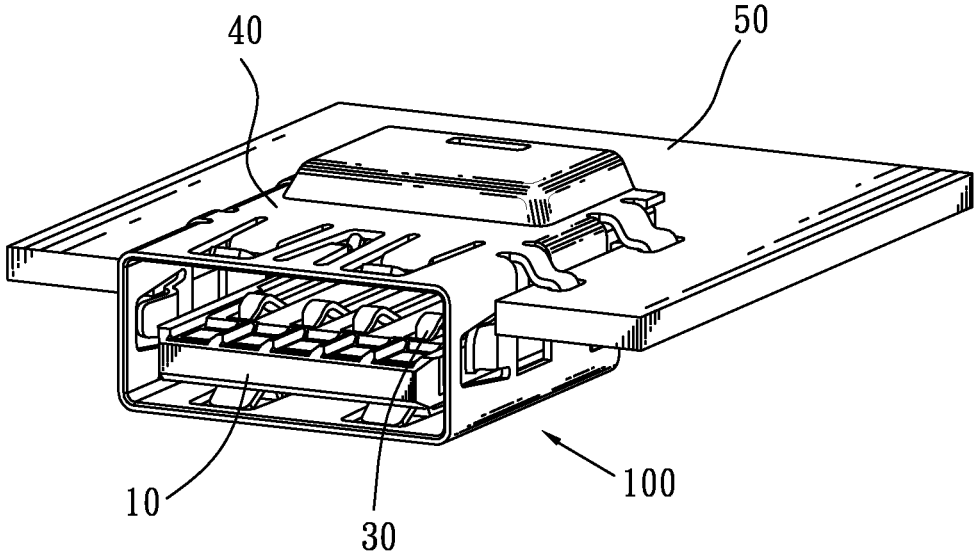
FIG. 1 is a perspective view of an electrical connector in accordance with the present invention, wherein the electrical connector electrically connects with a circuit board.
Figure 2:
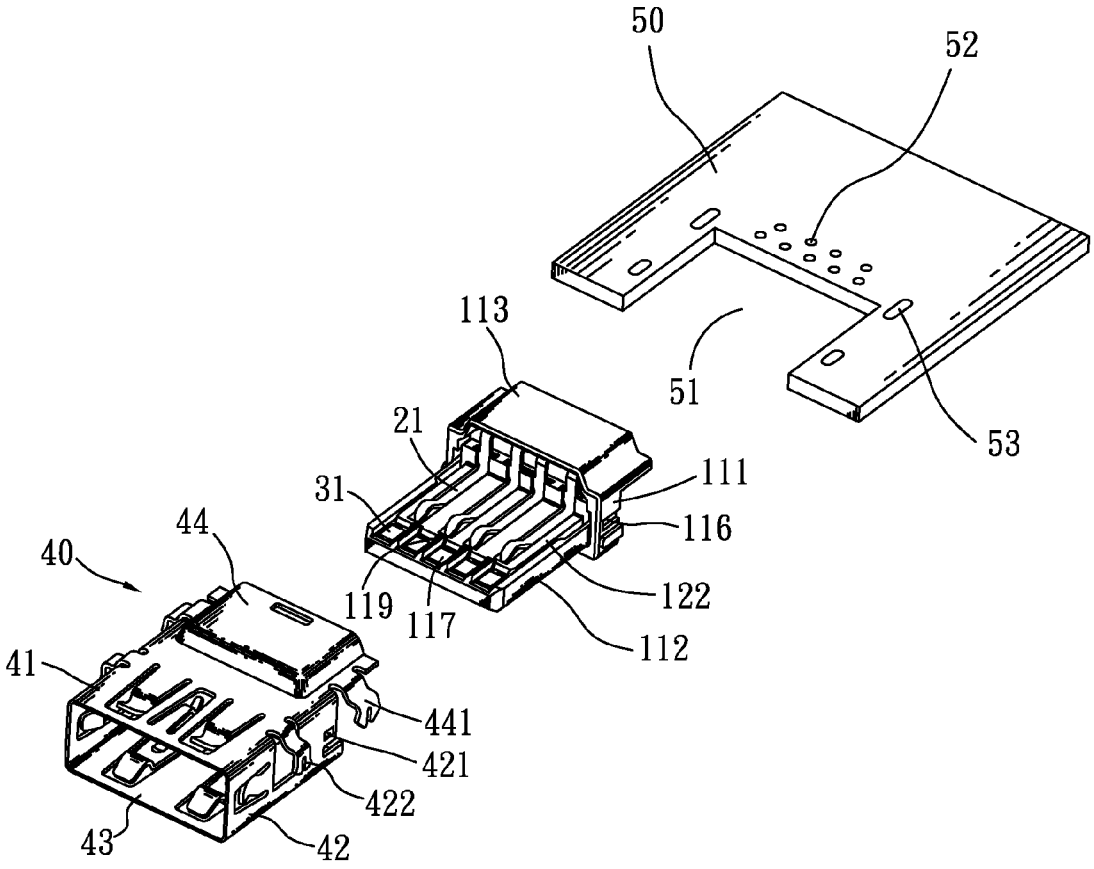
FIG. 2 is a partially exploded view of the electrical connector of FIG. 1, wherein the circuit board is apart from the electrical connector.
Figure 3:
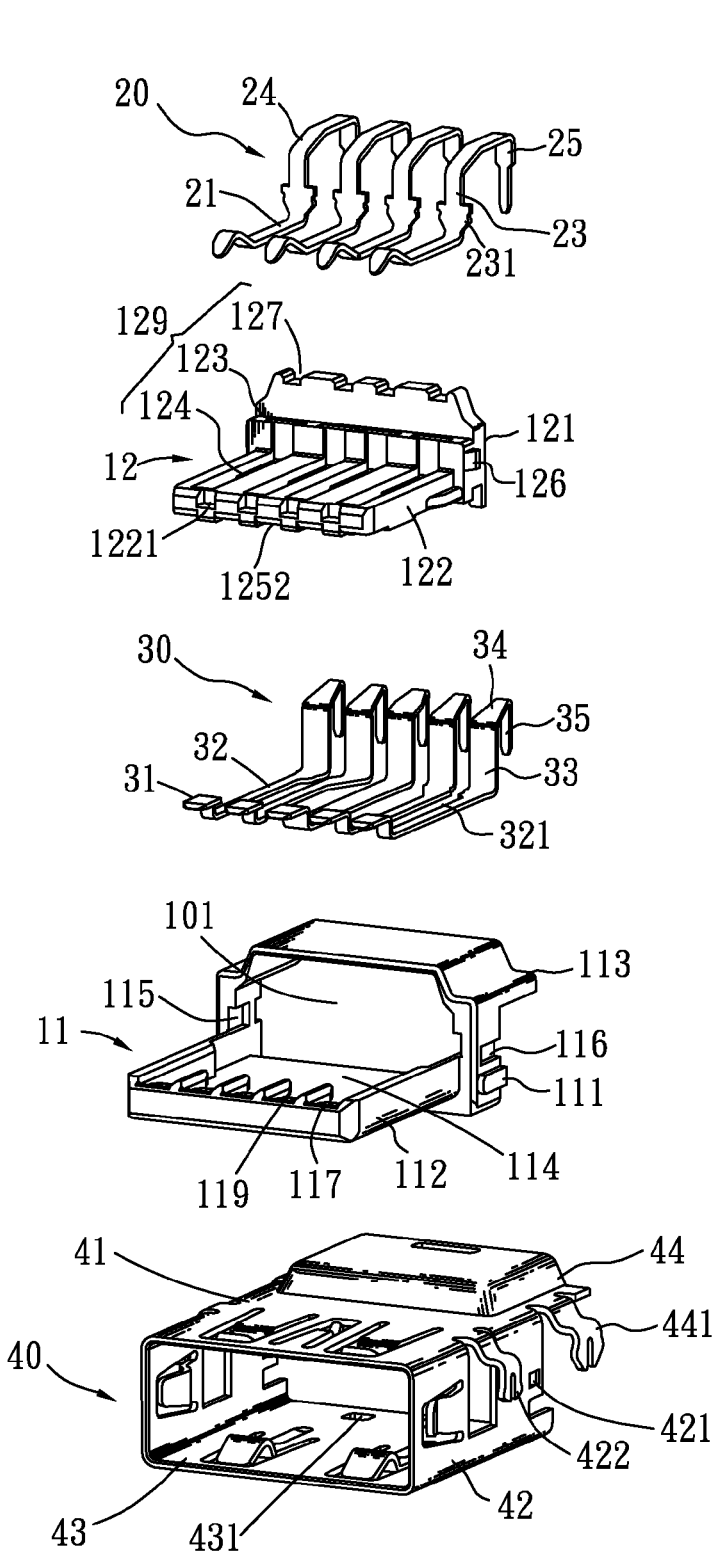
FIG. 3 is an exploded view of the electrical connector of FIG. 1.

With reference to FIG. 1, FIG. 2 and FIG. 3, an electrical connector 100 in accordance with the present invention is shown. The electrical connector 100 adapted for electrically connecting with a circuit board 50 includes an insulating housing 10, a plurality of first terminals 20, a plurality of second terminals 30 and a shielding shell 40. A middle of a front end of the circuit board 50 is recessed inward to form an assembling groove 51. The circuit board 50 defines a plurality of soldering holes 52 distributed at a rear of the assembling groove 51, and a plurality of inserting slots 53 distributed at two opposite sides of the assembling groove 51.

Figure 4:
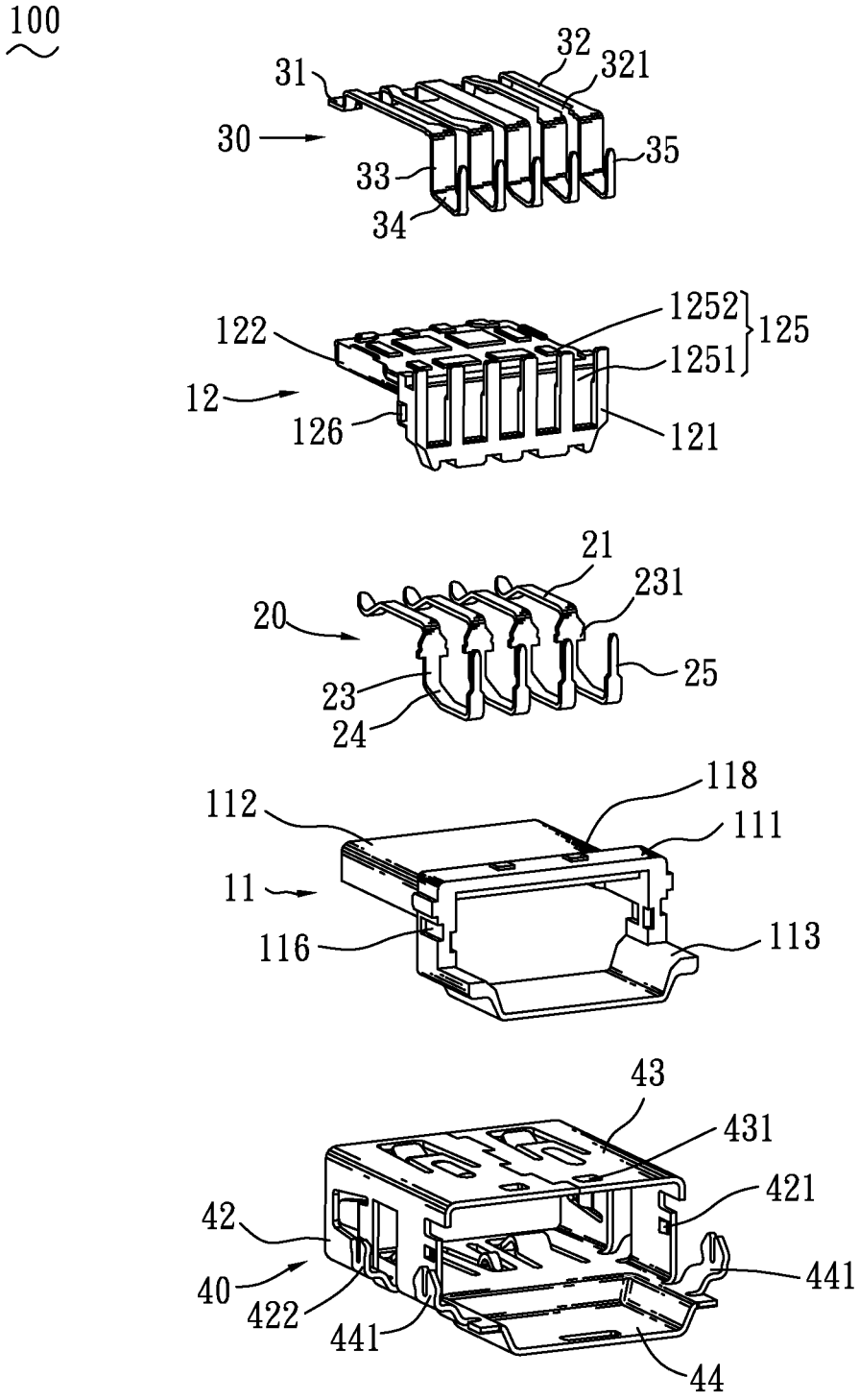
FIG. 4 is another exploded view of the electrical connector of FIG. 1.

Referring to FIG. 2, FIG. 3 and FIG. 4, the insulating housing 10 includes a main body 11, and a base body 12 assembled to the main body 11. The main body 11 has a ringlike base frame 111 from a front view with a window 101 formed therein. A lower part of an inner periphery of the base frame 111 extends forward to form a first tongue portion 112. A top of the base frame 111 spreads rearward to form a cover portion 113. The first tongue portion 112 defines a receiving groove 114 penetrating through a top thereof and communicating with the window 101, and a plurality of holding grooves 117 penetrating through the top thereof and communicating with the receiving groove 114. A portion between each two holding grooves 117 protrudes rearward to form a resisting portion 119. Two face-to-face inner sidewalls of the base frame 111 are concaved oppositely to form two restricting grooves 115 located above the first tongue portion 112. Two opposite outer surfaces of the base frame 111 are concaved inward to form two buckling grooves 116. Two portions of a bottom surface of the base frame 111 protrude downward to form two fastening blocks 118 spaced from each other.

Referring to FIG. 2, FIG. 3 and FIG. 4 again, the base body 12 has a step-shaped base portion 121, and a second tongue portion 122 protruding forward from a front of a lower step of the base portion 121. The base body 12 defines a plurality of first terminal grooves 129 of which each includes a clamping groove 123 vertically opened in the lower step of the base portion 121 and passing through a top and a front of the lower step of the base portion 121, a passage 124 opened longitudinally in a top of the second tongue portion 122 to communicate with a bottom of the corresponding clamping groove 123, and a notch 127 opened in a top of an upper step of the base portion 121. The base portion 121 of the base body 12 oppositely protrudes outward to form two restricting blocks 126. The base body 12 defines a plurality of second terminal grooves 125 of which each includes a fastening groove 1251 passing through a rear of the base portion 121, and a locating groove 1252 passing through a bottom of the second tongue portion 122 and communicating with the corresponding fastening groove 1251. A top of a front of the second tongue portion 122 defines a plurality of cavities 1221 alternating with the locating grooves 1252.

Figure 5:
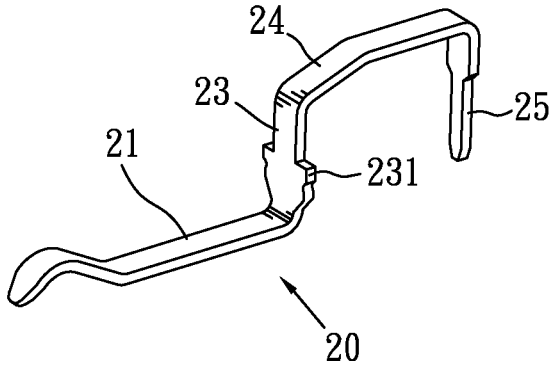
FIG. 5 is a perspective view of a first terminal of the electrical connector of FIG. 3.

Referring to FIG. 3, FIG. 4 and FIG. 5, each of the first terminals 20 has a first fastening arm 23 disposed vertically. A bottom end of the first fastening arm 23 extends forward, and then is arched upward to form a contact arm 21. A top end of the first fastening arm 23 is inclined rearward to form a first connecting arm 24. A free end of the first connecting arm 24 extends rearward and downward to form a first soldering arm 25 of inverted-L shape. Two opposite sides of the first fastening arm 23 of the first terminal 20 oppositely protrude sideward to form a plurality of clamping portions 231.

Figure 6:
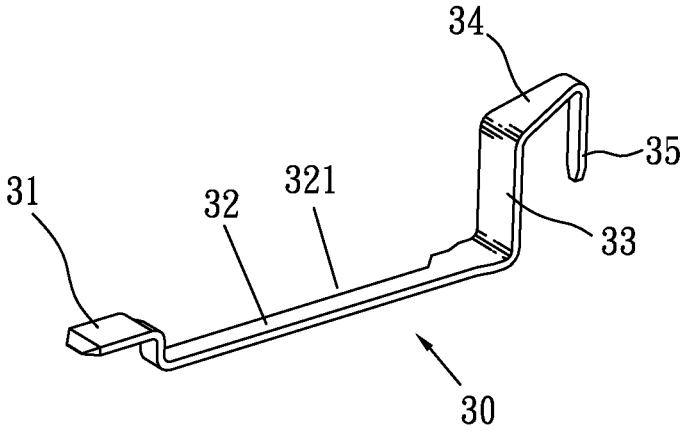
FIG. 6 is a perspective view of a second terminal of the electrical connector of FIG. 3.

Referring to FIG. 3, FIG. 4 and FIG. 6, each of the second terminals 30 has a fastening strip 32. A contact portion 31 extends forward in a step manner from a front end of the fastening strip 32. A rear end of the fastening strip 32 extends upward to form a second fastening arm 33 of which a free end is inclined rearward to form a second connecting arm 34. A free end of the second connecting arm 34 is bent downward to form a second soldering arm 35.

Referring to FIG. 2, FIG. 3 and FIG. 4, the shielding shell 40 has a top plate 41, two side plates 42 bending downward from two fronts of two opposite sides of the top plate 41, and a bottom plate 43 connecting with two bottoms of the two side plates 42. The top plate 41 is elongated rearward to form a cover plate 44. Two opposite side edges of the cover plate 44 are curved outward and downward to form a pair of first soldering plates 441. The side plates 42 are oppositely die-cut outward to form a pair of second soldering plates 422. Two middles of two rears of the two side plates 42 are punched inward to form two buckling pieces 421. A rear of the bottom plate 43 defines two fastening holes 431 spaced from each other.

Referring to FIGS. 1-6, when the electrical connector 100 is assembled, each of the first terminals 20 is assembled downward to the first terminal groove 129 of the base body 12. Specifically, the first fastening arm 23 is disposed in the clamping groove 123. The clamping portions 231 are clamped in two inner sides of the clamping groove 123. The contact arm 21 is received in the passage 124 with a front end thereof projecting beyond the top of the second tongue portion 122. The first connecting arm 24 passes through the corresponding notch 127. The first soldering arm 25 projects behind the base body 12 to be inserted in the soldering holes 52 of the circuit board 50. Each of the second terminals 30 is assembled upward to the second terminal groove 125 of the base body 12. Specifically, the fastening strip 32 is fastened in the locating groove 1252. The contact portion 31 projects in front of the base body 12. The second fastening arm 33 is disposed in the fastening groove 1251. The second connecting arm 34 and the second soldering arm 35 project behind the base body 12 to be inserted in the soldering holes 52 of the circuit board 50. Thus, the first terminals 20 and the second terminals 30 are reversely disposed to the base body 12 of the insulating housing 10 to expand distances between the first terminals 20 and the second terminals 30 so as to effectively prevent the first terminals 20 and the second terminals 30 from generating signal interferences.

Referring to FIGS. 1-6 again, assemble the base body 12 together with the first terminals 20 and the second terminals 30 to the main body 11. Specifically, the second tongue portion 122 of the base body 12 passes through the window 101 to be received in the receiving groove 114 with the contact portions 31 of the second terminals 30 being exposed in a front of the top of the first tongue portion 112, and the base portion 121 of the base body 12 are located in the window 101 of the base frame 111. The resisting portions 119 are resisted in the cavities 1221 of the second tongue portion 122, and the two restricting blocks 126 are restricted in the restricting grooves 115 of the base frame 111 respectively to assemble the base body 12 to the main body 11 firmly. In the meanwhile, the contact portions 31 are received in the holding grooves 117 with tops thereof exposing outside from tops of the holding grooves 117 to electrically contact with a mated connector. The contact arms 21 are exposed outside from a top of the receiving groove 114 to electrically contact with the mated connector. The first soldering arms 25 of the first terminals 20, the second connecting arms 34 and the second soldering arms 35 of the second terminals 30 are located under the cover portion 113. At last, assemble the shielding shell 40 to the main body 11 with the buckling pieces 421 being buckled in the buckling grooves 116 and the fastening blocks 118 being fastened in the fastening holes 431 to make the shielding shell 40 enclose the insulating housing 10 together with the first terminals 20 and the second terminals 30 firmly. The cover plate 44 covers on the cover portion 113 of the main body 11 for protecting the cover portion 113.

Referring to FIG. 2, FIG. 3, FIG. 4, FIG. 5 and FIG. 6, preferably, inner sides of the fastening strips 32 of the second terminals 30 which are assembled to two sides of the base body 12 are cut off to form gaps 321 for expanding distances between every two adjacent the fastening strips 32 of the second terminals 30 so as to effectively prevent the second terminals 30 from generating the signal interferences. The first fastening arm 23 and the first soldering arm 25 of the first terminal 20 are connected with each other by the upward inclined first connecting arm 24, and the second fastening arm 33 and the second soldering arm 35 of the second terminal 30 are connected with each other by the upward inclined second connecting arm 34 to effectively shorten straight lengths of the first terminal 20 and the second terminal 30 which are stretched straight so as to lower characteristic impedance values of the first terminal 20 and the second terminal 30.

Referring to FIG. 1, FIG. 2, FIG. 3 and FIG. 4, in use, the electrical connector 100 partially passes through the assembling groove 51 of the circuit board 50 to make the first soldering arms 25 of the first terminals 20 and the second soldering arms 35 of the second terminals 30 inserted into the soldering holes 52 of the circuit board 50 and soldered with the circuit board 50, and first soldering plates 441 and the second soldering plates 422 inserted into the inserting slots 53 and soldered with the circuit board 50 so as to mount the electrical connector 100 to the circuit board 50.

As described above, the first fastening arm 23 and the first soldering arm 25 of the first terminal 20 are connected with each other by the inclined first connecting arm 24, and the second fastening arm 33 and second soldering arm 35 of the second terminal 30 are connected with each other by the inclined second connecting arm 34 to effectively shorten the straight lengths of the first terminal 20 and the second terminal 30 which are stretched straight so as to lower the characteristic impedance values of the first terminal 20 and the second terminal 30. Therefore, the electrical connector 100 may pass a high-frequency test successfully. Furthermore, the first terminals 20 and the second terminals 30 are reversely disposed to the base body 12 of the insulating housing 10 to expand the distances between the first terminals 20 and the second terminals 30, and the fastening strips 32 of the second terminals 30 which are assembled to the two sides of the base body 12 have the gaps 321 for improving the distances between every two adjacent fastening strips 32 so as to effectively prevent the first terminals 20 and the second terminals 30 from generating the signal interferences.

What is claimed is:

1. An electrical connector adapted for electrically connecting with a circuit board, comprising:

an insulating housing including a main body, and a base body assembled to the main body, the base body having a base portion, and a second tongue portion protruding forward from a front of the base portion, the base body defining a plurality of first terminal grooves passing through a top of the second tongue portion and a top of the base portion, and a plurality of second terminal grooves passing through a bottom of the second tongue portion and a rear of the base portion;

a plurality of first terminals each having a first fastening arm which is disposed in the first terminal groove in the base portion, a contact arm extending forward from a bottom end of the first fastening arm and being received in the first terminal groove in the second tongue portion with a front end thereof being arched upward to project beyond the top of the second tongue portion, a top end of the first fastening arm being inclined rearward to form a first connecting arm passing through the top of the base portion, a free end of the first connecting arm extending rearward and then downward to form a first soldering arm of inverted-L shape projecting behind the base body to be inserted in the circuit board;

a plurality of second terminals each having a fastening strip which is fastened in the second terminal groove in the bottom of the second tongue portion, a contact portion extending forward in a step manner from a front end of the fastening strip to project in front of the base body, a rear end of the fastening strip extending upward to form a second fastening arm of which a free end is inclined rearward to form a second connecting arm, the second fastening arm being disposed in the second terminal groove in the rear of the base portion, a free end of the second connecting arm being bent downward to form a second soldering arm projecting behind the base body to be inserted in the circuit board; and a shielding shell enclosing the insulating housing together with the first terminals and the second terminals.

2. The electrical connector as claimed in claim 1, wherein the base portion of the base body is step-shaped with the second tongue portion protruding forward from a front of a lower step of the base portion, each first terminal groove includes a clamping groove vertically opened in the lower step of the base portion for inserting the first fastening arm of the first terminal therein, a passage opened longitudinally in the second tongue portion to communicate with a bottom of the corresponding clamping groove for receiving the contact arm therein, and a notch opened in the top of an upper step of the base portion with the first connecting arm passing therethrough.

3. The electrical connector as claimed in claim 2, wherein the first fastening arm of the first terminal oppositely protrude sideward to form a plurality of clamping portions clamped in two inner sides of the clamping groove.

4. The electrical connector as claimed in claim 1, wherein inner sides of the fastening strips of the second terminals which are assembled to two sides of the base body are cut off to form gaps for expanding distances between every two adjacent fastening strips of the second terminals.

5. The electrical connector as claimed in claim 1, wherein the main body has a ringlike base frame from a front view with a window formed therein, a lower part of an inner periphery of the base frame extends forward to form a first tongue portion which defines a receiving groove penetrating through a top thereof and communicating with the window, the second tongue portion of the base body passes through the window to be received in the receiving groove with the contact portions of the second terminals being exposed in a front of the top of the first tongue portion, and the base portion of the base body is located in the window of the base frame.

6. The electrical connector as claimed in claim 5, wherein a top of the base frame spreads rearward to form a cover portion under which the first soldering arms of the first terminals, the second connecting arms and the second soldering arms of the second terminals are located.

7. The electrical connector as claimed in claim 6, wherein the shielding shell has a bottom plate, two side plates and a top plate, the top plate is elongated rearward to cover on the cover portion of the main body, two opposite side edges of the elongated rear of the top plate are curved outward and downward to form a pair of first soldering plates, the side plates are oppositely die-cut outward to form a pair of second soldering plates, the first and the second soldering plates are inserted in the circuit board and soldered with the circuit board.

8. The electrical connector as claimed in claim 5, wherein two face-to-face inner sidewalls of the base frame are concaved oppositely to form two restricting grooves, the base portion of the base body oppositely protrudes outward to form two restricting blocks restricted in the restricting grooves of the base frame respectively.

9. The electrical connector as claimed in claim 5, wherein two opposite outer surfaces of the base frame are concaved inward to form two buckling grooves, and a bottom surface of the base frame defines two fastening blocks, the shielding shell has two side plates and a bottom plate, two rears of the two side plates are punched inward to form two buckling pieces buckled in the buckling grooves, a rear of the bottom plate defines two fastening holes for fastening the fastening blocks therein.

* * * * *